United States Patent [19]

Willoughby

[11] Patent Number: 4,553,479

[45] Date of Patent: Nov. 19, 1985

[54] PLASTIC BULLET

[75] Inventor: Marshall O. Willoughby, Orchard Lake, Mich.

[73] Assignee: Tolcon Steel Corporation, Grand Rapids, Mich.

[21] Appl. No.: 483,916

[22] Filed: Apr. 11, 1983

[51] Int. Cl.[4] ..... F42B 5/02

[52] U.S. Cl. ..... 102/430; 102/501; 102/529

[58] Field of Search ..... 102/430, 439, 444, 447, 102/501, 502, 508, 509, 445–446, 529; 244/3.23

[56] References Cited

U.S. PATENT DOCUMENTS

| | | | |
|---|---|---|---|
| 220,030 | 9/1879 | McGowan | 102/444 |
| 270,616 | 1/1883 | Taylor | 102/430 |
| 487,125 | 11/1892 | De LaTouche | 102/430 |
| 517,719 | 4/1894 | Aikin | 102/447 |
| 730,308 | 6/1903 | Stendebach | 244/3.23 X |
| 910,935 | 1/1909 | Meyer | 102/524 |
| 1,303,738 | 5/1919 | Stone | 102/398 |
| 1,681,295 | 8/1928 | Johnson | 102/509 |
| 2,315,853 | 4/1943 | Hodgson | 102/529 |
| 3,015,991 | 1/1962 | Forbes, Jr. | 244/3.23 X |
| 3,060,856 | 10/1962 | Dunn | 102/447 |
| 3,232,233 | 2/1966 | Singleton | 102/501 |

FOREIGN PATENT DOCUMENTS

| | | | |
|---|---|---|---|
| 196232 | 3/1908 | Fed. Rep. of Germany | 102/439 |
| 261392 | 6/1913 | Fed. Rep. of Germany | 102/430 |
| 246676 | 4/1926 | Italy | 102/501 |
| 522270 | 3/1958 | Italy | 102/503 |
| 318803 | 12/1969 | Sweden | 102/398 |
| 11747 | of 1896 | United Kingdom | 102/501 |
| 5012 | of 1909 | United Kingdom | 102/501 |

*Primary Examiner*—Harold J. Tudor

*Attorney, Agent, or Firm*—Price, Heneveld, Huizenga & Cooper

[57] ABSTRACT

The specification discloses a plastic bullet having improved accuracy and reusability. The bullet comprises a projectile, including a body and a stud, and a casing, defining a chamber for closely receiving the projectile stud. The projectile body has a reverse frustoconical shape and a blunt forward end defining a spherical segment depression. A plurality of pockets are defined by the body about its circumference. Both the case chamber wall and the projectile stud include interfitting serrations having different axial spacings to improve compression and releasability during firing. The projectile is hollow having a wall-mass-to-diameter ratio providing an improved gyroscopic effect. The casing includes a thick-wall blast chamber providing improved strength and reusability and enabling the use of high force primers.

7 Claims, 6 Drawing Figures

PLASTIC BULLET

BACKGROUND OF THE INVENTION

The present invention relates to bullets, and more particularly to polymeric bullets typically used for target practice.

A wide variety of reusable "plastic bullets" have been developed as an alternative to more expensive (per use) conventional ammunition. The plastic bullets are particularly well suited to target practice, wherein the distances involved are relatively short and the momentum of the projectile is not important. Basically, the plastic bullets include a projectile including a stud extending from the rearward portion thereof and a casing including a shoulder closely receiving the projectile stud. The casing defines a primer chamber and powder chamber communicating with the primer chamber which both may receive explosive material to fire the bullet. A primer alone projects the projectile satisfactorily for target practice. The plastic bullets are loaded and fired in a rather conventional manner; additionally, both the projectile and the casing can be retrieved and reloaded until one or the other fractures.

However, plastic bullets are not without their drawbacks. First, the polymeric, low-mass projectiles are inherently less accurate than conventional ammunition. The projectile receives insufficient spin from the firearm barrel rifling during firing to give the projectile the desired gyroscopic effect. The shape of known plastic projectiles creates excessive random air turbulence around the projectile during flight, causing the projectile to tumble end over end further reducing its range and/or accuracy. Consequently, known plastic bullets do not provide the accuracy and consistency required of serious marksmen during target practice.

Second, the prior plastic bullets have typically included a smooth interfit between the projectile stud and the casing shoulder. Consequently, some of the effectiveness of the discharged load is lost therebetween because of poor compression. This loss of compression further reduces the accuracy of the projectile.

Third, the casings of known bullets typically fracture after relatively few firings rendering the casings unsuited for further use. Additionally, known casings define large, powder chambers, which lose much of the explosive effect of the primer and/or powder.

SUMMARY OF THE INVENTION

The aforementioned problems are solved by the present invention comprising a plastic bullet providing unparalleled accuracy and reloadability through a unique projectile and casing. In a first aspect of the invention, the projectile comprises a projectile body having a reverse frustoconical shape with the larger base of the frustoconical shape comprising the forward end of the projectile body and the smaller base of the frustoconical shape comprising the rear end of the projectile body. This projectile shape causes minute air balls to be formed along the sides of the frustoconical body during firing, which air balls are believed to grip the firearm barrel rifling to impart increased rotational velocity to the projectile during discharge, improving the gyroscopic effect and accuracy of the projectile.

In a second aspect of the invention, the projectile defines a plurality of pockets about its circumference separated by ribs extending generally longitudinally to the projectile. The pockets terminate a short distance from the forward end of the projectile leaving an apron encircling the forward end of the projectile. The air pockets create and collect air pressure balls during discharge, which are believed to grip the barrel rifling to impart increased rotational velocity to the projectile. The increased rotational velocity improves the gyroscopic effect of the projectile and therefore its accuracy during flight.

In a third aspect of the invention, the projectile comprises a relatively blunt forward end defining a spherical segment depression. This depression-defining blunt forward end is believed to create and maintain an air ball at the forward end of the projectile during flight which stabilizes the projectile to prevent end-over-end tumbling. Consequently, the accuracy of the projectile is further improved.

In a fourth aspect of the invention, both the casing collar and the projectile stud each include a plurality of annular ridges which variably interfit when the stud is force fitted within the casing during loading. The annular ridges on the projectile define a first uniform axial spacing, and the ridges on the casing shoulder define a second uniform axial spacing different from the first spacing. Consequently, only certain ones of the ridges on the stud and casing wall will lockingly interfit at any given axial orientation of the projectile within the casing. The compression between the projectile and casing is improved over that of a smooth fit without seating the projectile so tightly that release problems will arise during firing. The ridge spacing providing that only selected ones of the ridges will interlock at any one time improves the plastic flow and releasability of the projectile from the casing. flow and releasability of the projectile from the casing.

In a fifth aspect of the invention, the projectile includes a rearwardly opening cylindrical blast chamber having a diameter approximately half as large as the largest outer diameter of the projectile.

In a sixth aspect of the invention, the bullet casing includes a relatively thick wall about the powder chamber to provide improved strength and reusability of the casing and also enabling larger primers to be used to fire the projectile. Preferably, the internal diameter of the casing powder chamber is generally the same as the projectile blast chamber communicating therewith.

The reasons why these various features improve performance of the cartridge and projectile of the present invention cannot be stated with certainty. They are basically hypothesis. However, it is known that these features yield a bullet which shows surprisingly unexpected performance results. These and other features, objects, advantages, and features of the invention will be more fully understood and appreciated by reference to the written specification and drawings.

DETAILED DESCRIPTION OF THE PREFERRED EMBODIMENT

Figure 2:
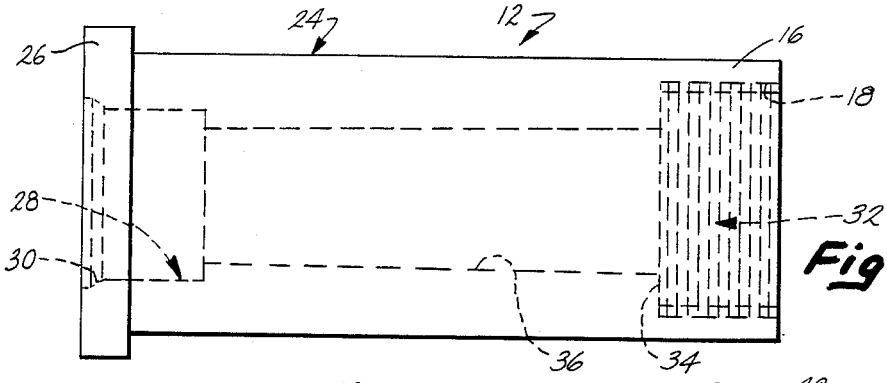
FIG. 2 is a side view of the casing.
Figure 3:
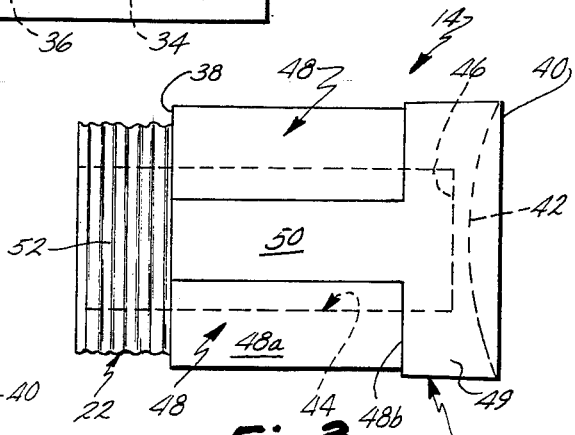
FIG. 3 is a side view of the projectile.
Figure 5:
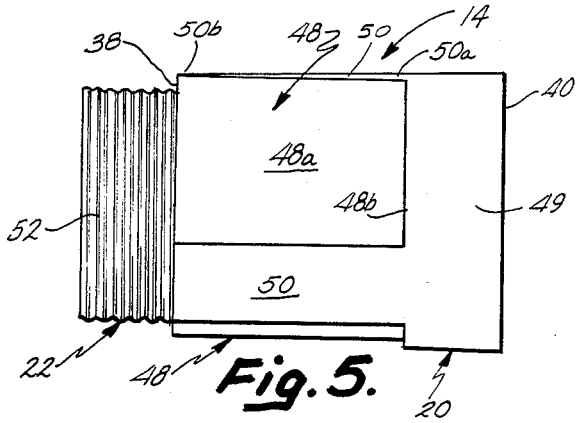
FIG. 5 is a side view of the projectile rotated 90° from the position shown in FIG. 3.
Figure 4:
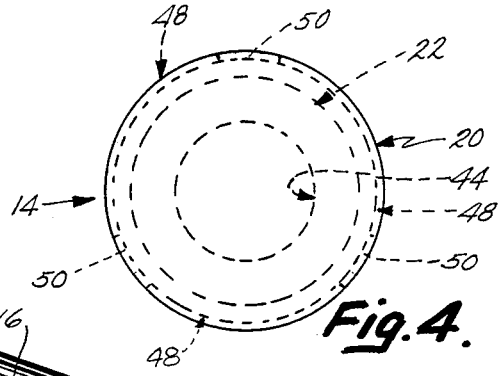
FIG. 4 is a front end view of the projectile.
Figure 1:
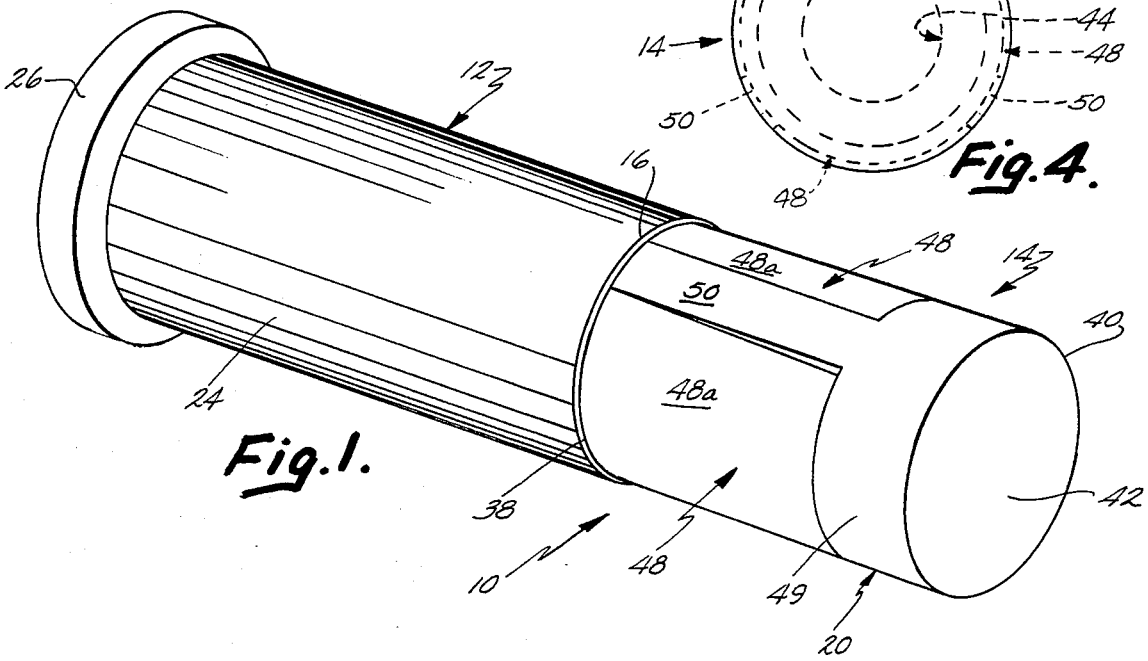
FIG. 1 is a perspective view of the plastic bullet of the present invention.

A plastic bullet 10 in accordance with a preferred embodiment of the invention comprises casing 12 (FIG. 2) and projectile 14 (FIGS. 3, 4, and 5). Casing 12 (FIG. 2) is generally a hollow cylinder including an annular collar 16 at its forward end defining a projectile-receiving chamber 18. Projectile 14 (FIG. 3) comprises a generally frustoconically shaped body 20 and stud 22 extending rearwardly therefrom. Both chamber 18 and stud 22 are dimensioned to closely interfit so that projectile 14 may be secured to casing 12 by push fitting the stud into the chamber.

Casing 12 (FIG. 2) comprises generally cylindrical body 24 and annular rim 26 generally concentric with and integral with the rear end thereof. Primer pocket 28 including beveled edge 30 is defined in the rearward end of casing body 24 to receive a conventional pistol primer. The primer pocket is beveled to facilitate the centering of the primer during loading. Beveled edge 30 makes it easier to load the primer.

Collar 16 at the forward end of casing 12 has an external diameter identical to that of body 24 and also defines cylindrical stud-receiving chamber 18 terminating at shoulder 34. A plurality of uniformly spaced annular serrations 32 on the inside of collar 16 line chamber 18. Powder chamber 36 is also generally cylindrical in shape having an internal diameter smaller than those of chamber 18 and primer pocket 28, and extends between primer pocket 28 and chamber 18. Casing 12 is thicker around powder chamber 36 in order to resist rupture when the powder is ignited. Preferably, the internal diameter of powder chamber 36 is generally the same as the internal diameter of blast chamber 44 in projectile 14. The relatively small diameter of the powder chamber forces the blast charge forwardly to propel the projectile at a relatively high velocity, thereby improving accuracy with increased distance. Typically, a primer alone in bullet 10 will provide a sufficient discharge force to accurately propel projectile 14.

Projectile 14 (FIGS. 3, 4, and 5) comprises generally frustoconically shaped body 20 and stud 22 extending rearwardly therefrom. Body 20 includes a rearward end 38 and a forward end 40 (FIGS. 3 and 5). The larger base of the frustoconical shape comprises forward end 40, while the smaller base of the frustoconical shape comprises rearward end 38. The degree of frustoconical taper is slight. Forward end 40 (FIG. 3) defines a spherical segment depression 42 generally concentric with and extending generally to the perimeter of the forward end.

Projectile 14 has a hollow interior chamber 44 (FIGS. 3 and 4) which is generally cylindrical and extends through stud 22 and body 20 to forward wall 46 just short of depression 42. When projectile 14 is seated within casing 12, chamber 44 communicates directly with powder chamber 36 in the casing. The diameter of blast chamber 44 is approximately half as large as the largest outer diameter of projectile 14. Chamber 44 should not be much larger, because it would reduce the mass of the wall of projectile 14, thereby reducing gyroscopic effect. Chamber 44 should not be much less in diameter, for projectiles with thicker peripheral walls do not perform as well as the projectile of this invention. It is hypothesized that the added mass towards the centerline of the projectile acts inertially to make it more difficult to get the projectile spinning when it is fired. This would reduce the gyroscopic effect of the projectile. However, this is hypothesis only and the overall success acheived by this projectile is both surprising and not totally explained.

Chamber 44 extends forwardly substantially to the front of projectile 14. It is important that a front wall be left which is sufficiently thick to minimize rupture on firing or on impact. Also, one must experiment some with the front wall thickness in order to make certain one obtain a relatively uniform depression 42 at the front of projectile 14, rather than simply an irregular sink mark.

Three pockets 48 (FIGS. 3, 4, and 5) are located about the periphery of projectile body 20. Each of pockets 48 comprises a floor **48*a* and a forward edge 48*b* located a short distance rearwardly of forward end 40 to define a smooth apron 49 therebetween. Each of pocket floors 48*a* comprises a segment of a right cylindrical wall. That is to say that each of pocket floors 48*a* is generally parallel to the axis of projectile 14. Three ribs 50 separate pockets 48 and extend from rearward end 38 to collar 49. Preferably, the circumferential width of ribs 50 is less than the circumferential width of pockets 48, and most preferably approximately one-half the circumferential width of the pockets. Because of the frustoconical shape of projectile body 20, each forward end 50*a* of rib 50 is thicker than rearward end 50*b* which is generally flush with pocket floors 48*a*** (FIG. 5).

Stud 22 is generally cylindrical in shape and includes a plurality of annular ridges 52 along its length. The term "ridges" is used for convenience of description rather than to suggest a substantial structural difference from serrations 32. Ridges 52 are axially uniformly spaced differently from the spacing defined by serrations 32 in collar 16.

Figure 6:
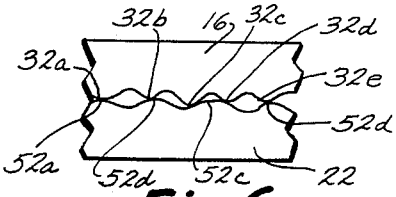
FIG. 6 is an enlarged fragmentary sectional view of the interfitting projectile stud and casing shoulder.

An enlarged detail of the interfitting of stud 22 within collar 16 is most clearly illustrated in FIG. 6. Ridges 52 on stud 22 define an axial spacing larger than the axial spacing between serrations 32 on collar 16. Consequently, not all of serrations 32 can interfit with ridges 52 at the same time. Specifically, only serration **32*c* fully seats between a pair of adjacent ridges 52, namely 52*b* and 52*c*. The remainder of serrations 32 are prevented from fully seating by other ridges 52; namely, 52*a* abuts 32*a*; 52*b* abuts 32*b*; 52*c* abuts 32*d*; and 52*d* abuts 32*e*. The axial orientation of stud 22 with respect to collar 16 will determine which one of serrations 32 fully seats between a pair of opposite ridges 52. Preferably, the height of serrations 32 and ridges 52 is less than one one-hundredth of the diameter of chamber 18 and stud 22, respectively, so that casing 12 does not grip projectile 14** too tightly, while still providing improved compression.

Both casing 12 and projectile 14 are fabricated of a high impact resin, for example a phenylene oxide such as that sold under the trademark NORYL 731 by the Noryl Products Division of General Electric of Selkirk, N.Y. Consequently, the casing and projectile can withstand repeated firings; and the projectile leaves a minimum of residue in the firearm barrel.

The resin should have a density of at least 1.0 and preferably greater than 1. Most preferably, the density should be greater than 1.05. Noryl 731 has a density of 1.06. It should also have a high heat resistance, i.e., a heat distortion temperature, as determined by ASTM testing, in excess of about 250° F. Noryl 731 has a heat distortion temperature of 265° F.

The following dimensions are provided as being exemplary of one set of dimensions suitable for a plastic bullet 10 usable in a 38-caliber pistol. All dimensions are expressed in fractions of an inch.

| Dimension | Description |
|---|---|
| .180 | Internal diameter of projectile chamber 44 |
| .312 | External diameter of projectile stud 22 |
| .344 | External diameter of rearward end 38 |
| .348 | External diameter of forward end 40 |
| .538 | Depth of projectile chamber 44 |
| .460 | Length of projectile body 20 |
| .597 | Length of projectile 14 |
| .0025 | Maximum depth of depression 42 |
| .123 | Length of projectile apron 49 |
| .123 | Width of projectile rib 50 |
| .0003 | Depth of serrations on projectile stud 22 |
| .163 | Internal diameter of powder chamber 36 |
| .210 | Internal diameter of primer pocket 28 |
| .250 | Maximum internal diameter on beveled edge 30 of primer pocket |
| .314 | Internal diameter of collar 16 |
| .375 | External diameter of casing body 24 |
| .431 | External diameter of casing rim 26 |
| .131 | Depth of stud-receiving chamber 18 |
| .540 | Length of powder chamber 36 |
| .123 | Depth of primer pocket 28 |

Assembly and Operation

To prepare plastic bullet 10 for firing, projectile 14 is secured to casing 12 by inserting and press-fitting stud 22 into chamber 18 defined by collar 16. Preferably, projectile 14 is fully inserted into casing 12 until stud 22 seats on chamber shoulder 34 or until rear wall 38 seats on the leading edge of collar 16. Because of the different uniform spacings defined by annular serrations 32 and ridges 52, only selected ones of serrations 32 will fully seat between ridges 52. The particular serrations 32 which do so fully seat depends upon the axial orientation of stud 22 within chamber 18. However, the spacings help insure that at least one ridge and serration will fully interlock at any degree of insertion of the stud within the chamber. The number of serrations is preferably selected so that exactly one serration 32 does so fully seat. A pistol primer is installed within primer pocket 28 utilizing any method well known to those having ordinary skill in the art. Plastic bullet 10 so prepared may then be utilized in a manner similar to conventional ammunition for firing from a firearm. Gun powder is not required to fire bullet 10. The explosive charge of the pistol primer is adequate to properly propel projectile 14. Gunpowder can be used if desired.

When bullet 10 is fired, serrations 32 and ridges 52 on stud 22 and collar 16 improves compression between projectile 14 and casing 12 to take maximum advantage of the discharge force of the primer. The interfitting of one and only one serration 32 with one of ridges 52 provides the requisite compression while providing a smooth plastic flow during the release of projectile 14 from casing 12.

The aerodynamics of the fired projectile 14 significantly increase the accuracy of bullet 10. Because of the frustoconical shape of projectile body 20, minute air balls are formed along the sides of the frustoconical shape behind the relatively large forward end 40. These air balls grip the rifling within the barrel of the firearm to impart increased rotational velocity to projectile 14. Further, pockets 48 also tend to create and entrap minute air balls which also grip the barrel rifling to spin the projectile. As is well known, the greater the rotational velocity of projectile 14, the greater the gyroscopic effect thereof maintaining the projectile on a true flight path and reducing end-over-end tumbling. Consequently, the frustoconical shape of body 40 and pockets 48 increase the rotational velocity and therefore accuracy of projectile 14. Depression 42 in forward end 40 of projectile 14 forms an air ball on the forward end of the projectile during flight. This air ball stabilizes projectile 14 and further reduces the tendency of the projectile to tumble end over end during its flight.

The above description is intended to be that of a preferred embodiment of the invention. Various changes and Alterations might be made without departing from the spirit and broader aspects of the invention as set forth in the appended claims, which are to be interpreted in accordance with the principles of patent law, including the doctrine of equivalents.

The embodiments of the invention in which an exclusive property or privilege is claimed are defined as follows:

1. A bullet projectile comprising:

a body portion having a blunt forward end and a rearward end, said body portion being frustoconically shaped and including a larger base comprising said forward end and a smaller base comprising said rearward end, whereby, during travel in a firearm barrel, said frustoconically shaped body creates air turbulence along the side of said body portion to coact with any rifling in the barrel, said body portion defining a plurality of pockets about the body circumference, said pockets being separated by ribs longitudinal to said body, each of said pockets terminating short of said forward end of said body, each of said ribs tapering from said forward end to said rearward end, each of said pockets including a floor comprising a segment of a right circular cylinder; and means for securing said rearward end of said body portion to a bullet casing, said securing means being concentric with and diametrically smaller than said rearward end of said body portion.

2. A bullet projectile as defined in claim 1 wherein each of said pockets is circumferentially wider than any of said ribs.

3. A bullet projectile as defined in claim 1 wherein said forward end defines a depression whereby an air ball is formed at said forward end during flight of said projectile.

4. A bullet projectile as defined in claim 3 wherein said depression is a spherical segment concentric with said forward end of said body portion.

5. A bullet projectile as defined in claim 1 wherein said body portion defines a substantially cylindrical blast chamber concentric with said body portion and opening through said rearward end, the diameter of said blast chamber being approximately half as large as the greatest outer diameter of said body portion.

6. An improved bullet including a projectile, having a stud, and a casing having a chamber wall defining a chamber for closely receiving said projectile stud to retain said projectile in said casing, the improvement comprising:

a plurality of annular, uniformly axially spaced ridges extending from said stud; and said chamber wall having a plurality of annular, uniformly axially spaced serrations, the spacing of said serrations being different from the spacing of said ridges, whereby not all of said ridges and said serrations will matingly engage at one time regardless of the axial orientation of said stud within said chamber, whereby said projectile releases from said casing relatively smoothly.

7. An improved bullet as defined in claim 6 wherein the ridge spacing and the serration spacing are selected such that only one of said serrations and one of said ridges will matingly engage at any one time regardless of the axial orientation of said stud within said chamber.

* * * * *